US005845518A

United States Patent [19]

Webber

[11] Patent Number: 5,845,518

[45] Date of Patent: Dec. 8, 1998

[54] EARRING

[75] Inventor: Meridyth Mischel Webber, Teaneck, N.J.

[73] Assignee: Khreativity Unlimited, Inc., Teaneck, N.J.

[21] Appl. No.: 974,539

[22] Filed: Nov. 19, 1997

Related U.S. Application Data

[63] Continuation-in-part of Ser. No. 748,504, Nov. 8, 1996, abandoned.

[51] Int. Cl.[6] ..... A44C 7/00

[52] U.S. Cl. ..... 63/14.4; 63/14.2

[58] Field of Search ..... 63/13, 14.1, 14.4, 63/14.2, 14.3, 14.5, 14.6, 14.7, 14.8, 14.9

[56] References Cited

U.S. PATENT DOCUMENTS

| | | | |
|---|---|---|---|
| 20,480 | 6/1858 | Carpenter . | |
| D. 155,511 | 10/1949 | Janousek . | |
| D. 189,793 | 2/1961 | Howard . | |
| 2,013,760 | 9/1935 | McSoley | 63/14.1 X |
| 2,040,083 | 5/1936 | Elliott et al. | 63/14.2 |
| 2,351,925 | 6/1944 | Chernow | 63/14.4 |
| 2,511,170 | 6/1950 | McCann . | |
| 2,542,730 | 2/1951 | Thronsen | 63/14.2 |
| 2,610,486 | 9/1952 | McCann . | |
| 2,764,000 | 9/1956 | Lippmann | 63/14.2 |
| 2,823,526 | 2/1958 | Crigler | 63/14.1 |
| 3,020,734 | 2/1962 | Withers | 63/14.4 |
| 4,704,878 | 11/1987 | Saraga . | |
| 4,724,684 | 2/1988 | Barnett | 63/14.1 |
| 4,840,045 | 6/1989 | Moody | 63/14.5 X |
| 5,097,682 | 3/1992 | Nakamura | 63/14.2 X |

FOREIGN PATENT DOCUMENTS

| | | |
|---|---|---|
| 947 523 | 8/1956 | Germany . |
| 433886 | 9/1995 | United Kingdom . |

*Primary Examiner*—David Purol
*Attorney, Agent, or Firm*—Lerner, David, Littenberg, Krumholz & Mentlik

[57] ABSTRACT

An earring is disclosed which can be securely mounted on nonpierced ears. The earring comprises at least one ornamental component and has a backing which facilitates mounting of the earring without piercing of the ear.

21 Claims, 2 Drawing Sheets

EARRING

CROSS-REFERENCE TO RELATED APPLICATIONS

This application is a continuation in part of patent application Ser. No. 08/748,504 which was filed on Nov. 8, 1996 now abandoned.

FIELD OF THE INVENTION

The present invention relates to the field of earrings. More particularly, the present invention relates to earrings which can be mounted on non-pierced ears.

BACKGROUND OF THE INVENTION

Several types of earrings exist in the prior art. These earrings are adapted to be attached to a person's ear in different ways. Each of the prior art types of earrings and methods of wearing such earrings have shortcomings.

The most common type of earring is one which is intended to be worn by people who have pierced ears. This requires puncturing of the ear lobe or another portion of the ear with a sharp object. This may be a painful procedure and often results in one or more permanent holes in a person's ear. Pierced earrings include an elongated mounting member, such as a post, which is intended to be inserted through the pierced opening of the earlobe, or other pierced openings in the ear. A separate earring back is often arranged on the post to secure the earring in assembled position on a pierced ear. Pierced earrings also include various other types of securing devices which secure the post to a portion of the earring after the post has been inserted through the opening in a person's ear.

Pierced earrings have several shortcomings. One such shortcoming is that heavy earrings may cause discomfort to the wearer, and may create an undesirable enlarged opening in the ear. Further, pierced ears may become infected or particularly sensitive to certain types of earrings. For example, many people who have pierced ears are required to wear gold earrings or other hypoallergenic type of earring. Another shortcoming associated with pierced ears is that if a great force is applied to the earring, it may rip through the pierced opening thus causing a tear through the external portion of a person's ear. This may occur, for example, in a robbery or athletic events.

A second type of earring is known as a clip-on earring. These earrings do not require pierced ears. However, various shortcomings also exist with clip-on earrings. For example, clip-on earrings often utilize clamps which do not exert sufficient force on the earlobe to securely retain the earring in place. This may result in the clip-on earring falling off during the course of the day. This is particularly a problem for active people who prefer to wear jewelry during exercising and athletic events.

A third type of earring has been commercialized more recently than the two aforementioned types of earrings. This third type of prior art earring may also be worn without pierced ears. In particular, the third type of prior art earring includes a pair of mounting members. One mounting member includes a spherical ball which is adapted to rest within an external cavity at the front of the ear. The second mounting member merely includes a spherical head which engages the rear portion of the ear around the earlobe. Such an earring was invented by the inventor herein. A similar type of earring is also disclosed in U.S. Pat. No. 4,704,878 which issued to Saraga. Although this third type of earring, such as the earring disclosed in the '878 patent to Saraga, has certain advantages over pierced earrings and traditional clip-on earrings, it also has shortcomings in that it is limited to a particular hoop style of earring.

Prior art patents also disclose earrings which may be supported within the external cavity at the front of the ear and which include a clamping member for securing the earring behind the earlobe. For example, such earrings are disclosed in U.S. Pat. Nos. 5,097,682 which issued to Nakamura, and 2,542,730 which issued to Thronsen. However, these patents do not disclose or teach critical and unobvious size requirements and thus, the earrings disclosed therein are believed to be ineffective.

SUMMARY AND OBJECTS OF THE INVENTION

The present invention overcomes the various shortcomings associated with the foregoing prior art earrings. In particular, the present invention provides an earring having a universal backing which can be used with many types of earrings while at the same time overcoming the problems associated with earrings intended for pierced ears, clip-on earrings and the particular style of earring disclosed in the '878 patent.

In a preferred embodiment of the present invention, an earring is provided which comprises at least one ornamental component. A backing may be provided which comprises a mounting member and a clamp. The mounting member may be rigidly connected to the at least one ornamental component and may be adapted to rest within an external cavity at the front of the ear adjacent to the auricle thereof. The clamp is preferably connected to the at least one ornamental component for pivotal movement between a disengaged position where it is remote from the ear and an engaged position where it is placed in contact with the rear side of the earlobe so that secured assembly of the at least one ornamental component on the ear is facilitated.

In a preferred embodiment, the at least one ornamental component may comprise a single ornamental component. This ornamental component is the design portion of the earring which is typically displayed when mounted on an ear. In other preferred embodiments, elaborate earrings may be provided which comprise more than one ornamental component. In these preferred embodiments, the various ornamental components are often interconnected with each other. An example of such embodiment may comprise an earring having an interlocking hoop design.

In another preferred embodiment, the mounting member may include an elongated arm having a first end and a second end. The first end is preferably connected to the ornamental component. The second end of the elongated arm preferably comprises a spherical member. The spherical member may be constructed and arranged to rest within the external cavity at the front of the ear. Preferably, the construction of the spherical member is such that it is comfortable when placed in assembled position within the external cavity of the ear.

Preferably, the elongated arm has an arcuate configuration extending between the first end and the second end thereof. When mounted in assembled position on a person's ear, the arcuate elongated arm may extend downwardly from a portion of the ornamental component to the external cavity at the front of the ear where the spherical member arranged on the second end of the elongated arm is placed.

It is preferable for the distance between the top-most portion of the clamp and the bottom-most portion of the spherical member to be less than about 1.25 cm (about one half inch) when mounted on a person's ear. In an even more preferred embodiment, the distance between the top-most portion of the clamp and the bottom-most portion of the spherical member is between about 1.0 mm–10 mm. The most preferred distance is about 4.0 mm. It should be appreciated that the foregoing dimensions are an important aspect of the present invention and constitute a novel and unobvious improvement over prior art earring designs.

In yet another preferred embodiment, the earring of the present invention may further comprise an extension member connected to the ornamental component. In this preferred embodiment, the clamp may be pivotally connected to the extension member in a position spaced from the ornamental component for selective movement toward or away from an earlobe and the ornamental component to facilitate mounting of the earring on a person's ear. It is also preferable for the earring of the present invention to comprise retention means for retaining the clamp in the engaged position against a person's earlobe. The retention means may comprise a frictional engagement between the clamp and the extension member at the pivotal connection.

The clamp of the present earring may have various configurations. In one preferable configuration, the clamp may comprise an omega backing member. Such an omega backing member has been used in connection with prior art clip-on earrings. The omega backing member is preferably about 1.5–2.5 cm in length, and is even more preferably about 1.8 cm (about three quarters of an inch) long.

In another preferred embodiment, the mounting member of the present earring is integral with the ornamental component. In this preferred embodiment, a clamp may still be pivotally connected to the ornamental component or to an extension member which is connected to the ornamental component. It should be appreciated that the term"connected" as used herein contemplates both integral and composite components. Integral components may be said to have integrally formed connections (such as a one-piece molded earring), welded connections or connections formed by any conventional means used for connecting two or more composite components.

In still another preferred embodiment, the distance between the bottom-most portion of the spherical member and the pivotal connection at the location between the clamp and the extension member is between about 2.0 cm–3.0 cm. It is even more preferable for such distance to be about 2.2 cm. In most instances, this distance will assure that the bottom of the omega backing member (i.e., the location where the omega backing is pivotally connected to the extension member) does not push upwardly against the earlobe.

It should also be appreciated that the term "spherical member" as used herein comprises a member where at least a portion thereof is rounded or spherical in configuration. This includes semi-spherical members, partially spherical members, and fully spherical members.

It should also be appreciated that the term backing as used herein comprises various means for mounting an earring in assembled position on a person's ear. In a preferred embodiment of the present invention, the backing comprises a combination of a mounting member and a clamp.

Accordingly, it is an object of the present invention to provide an earring having means for obtaining mounting of an earring in a secured position on unpierced ears.

It is a further object of the present invention to provide an earring having a universal backing which can be applied to various types of earrings to permit such earrings to be secured to a person's ear.

It is yet another object of the present invention to provide an earring having a backing which is particularly effective for mounting relatively heavy earrings in a secure manner on a person's ear without discomfort.

These and other objects and advantages of the present invention will be more readily understood when considered in conjunction with the detailed description of the present invention which follows and the accompanying drawings.

DETAILED DESCRIPTION OF THE PREFERRED EMBODIMENTS

Figure 1:
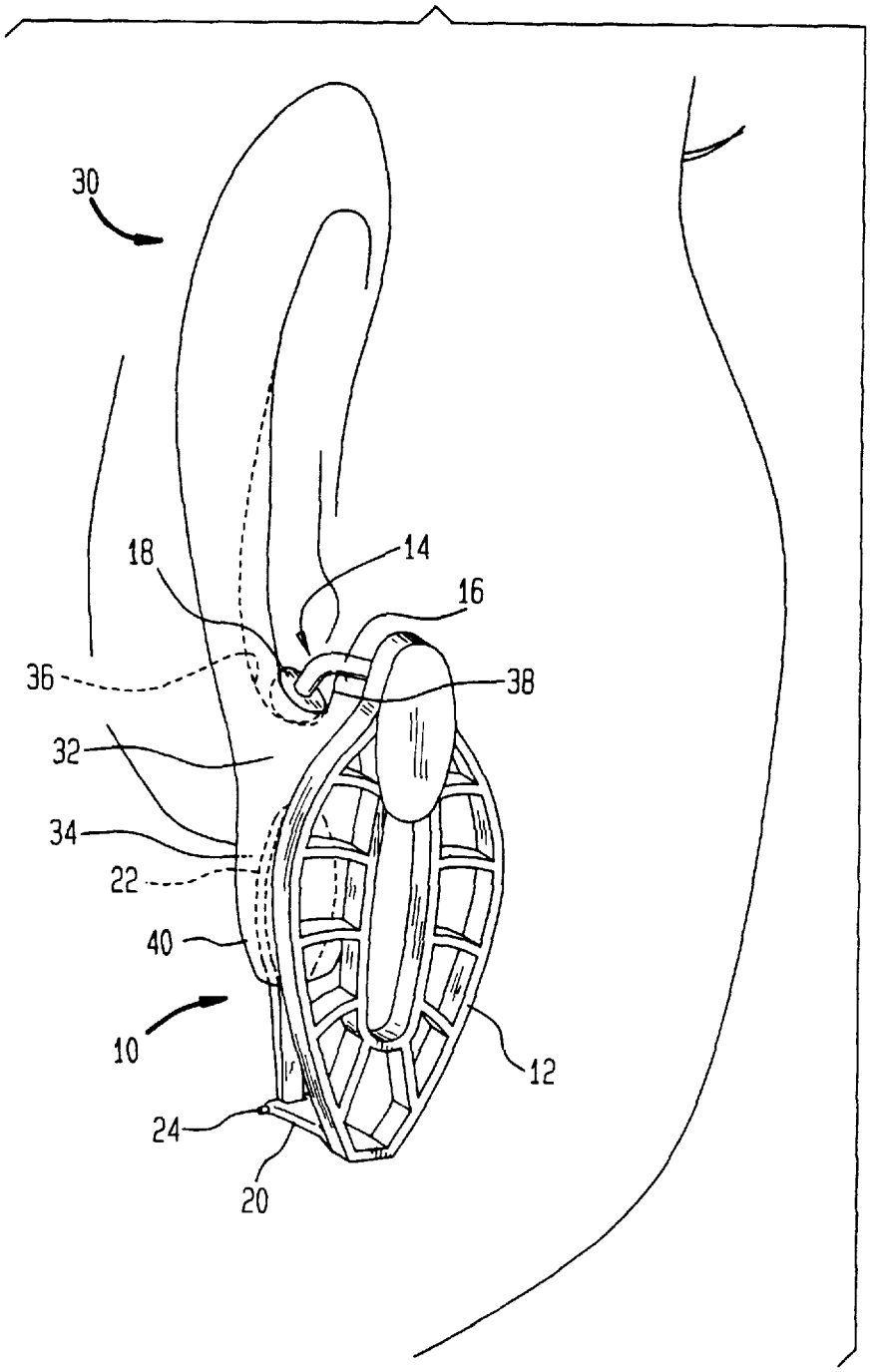
FIG. 1 is a perspective view of a preferred embodiment of an earring mounted on an ear.
Figure 2:
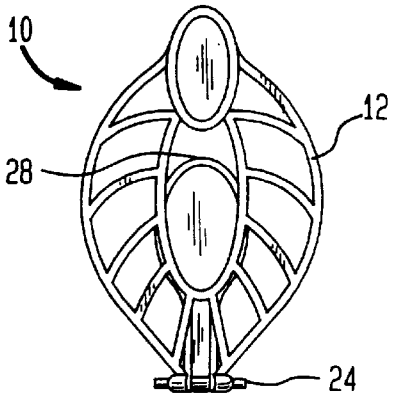
FIG. 2 is a front view of the earring shown in FIG. 1.
Figure 3:
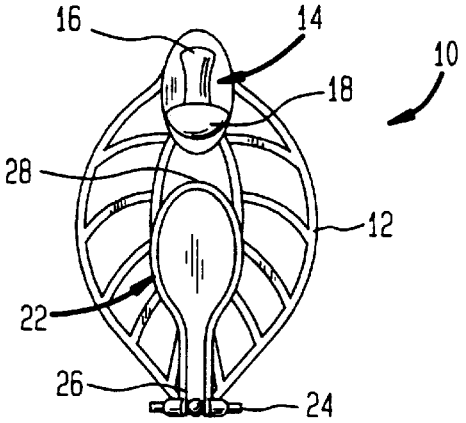
FIG. 3 is a rear view of the earring shown in FIGS. 1 and 2.
Figure 4:
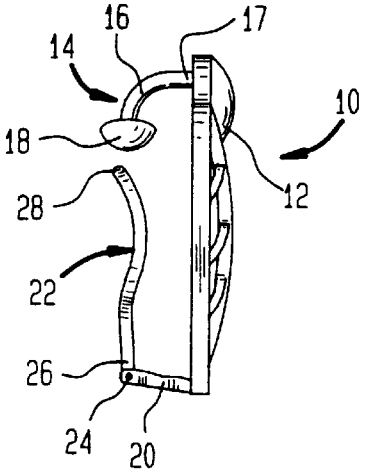
FIG. 4 is a left side view of the earring shown in FIGS. 1–3 with the clamp portion shown in an upright position where it can be engaged with an earlobe.
Figure 5:
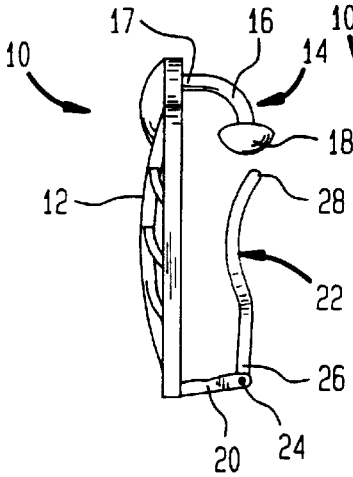
FIG. 5 is a right side view of the earring shown in FIGS. 1–3 with the clamp portion shown in an upright position where it can be engaged with an earlobe.

An earring in accordance with a preferred embodiment of the present invention is generally designated 10 in FIGS. 1–8. The earring 10 includes an ornamental component 12 which is the decorative portion of the earring that is displayed when the earring is in assembled position on a person's ear.

In the preferred embodiment shown in FIGS. 1–8, the ornamental component 12 comprises a single decorative component. It should be understood that in alternate embodiments of the present invention, the ornamental component 12 may comprise a plurality of decorative components. For example, the ornamental component may comprise two or more interconnected design components, such as interlocked hoops or other components.

The earring 10 may be made of various desirable materials. For example, the earring 10 may be made of gold, silver, hypoallergenic metals, polymeric materials, etc.

The novelty of the earring 10 pertains to a unique backing which can securely mount the ornamental component 12 on non-pierced ears. As shown in FIGS. 1–8, the novel backing comprises the combination of a mounting member 14 and a clamp 22. The mounting member 14 includes an elongated arcuate arm 16 which has a first end 17 connected to the rear side of the ornamental component 12. The elongated arcuate arm 16 also includes a second end which terminates at spherical member 18. In accordance with the preferred embodiment of the earring 10 shown in FIGS. 1–8, the elongated arcuate arm 16 extends generally downwardly from its first end 17 to the bottom-most portion of the spherical member 18. The downwardly extending configuration of the elongated arcuate arm 16 serves the useful function of facilitating mounting of the earring on an ear as will be discussed below.

Figure 6:
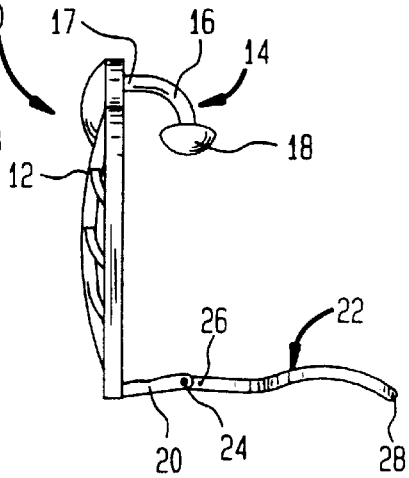
FIG. 6 is a right side view of the earring shown in FIGS. 1–3 with the clamp portion shown in a horizontal position where it would be disengaged from an earlobe.
Figure 7:
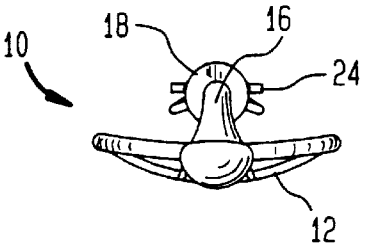
FIG. 7 is a top plan view of the earring shown in FIGS. 1–5.
Figure 8:
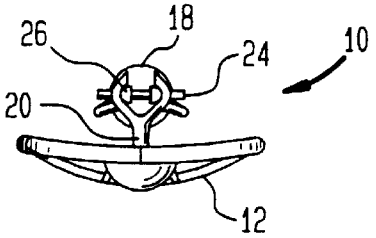
FIG. 8 is a bottom plan view of the earring shown in FIGS. 1–5.

The mounting member 14 can be considered a first component of the novel backing of the earring 10 of the present invention. The second component of the novel backing is a clamp 22 which is constructed and arranged for pivotal movement between an upright position at which it is adapted to engage an earlobe shown in FIGS. 1–5, and a horizontal position where it could be disengaged from an earlobe as shown in FIG. 6. This aspect of the present invention will also be discussed further below.

In the preferred embodiment of the present invention shown in FIGS. 1–8, an extension member 20 is connected to the rear side of the ornamental component 12. The clamp 22 is then connected directly to the extension member 20 at pivotal connection 24 for pivotal movement between an upright position and a horizontal portion (i.e., an engaged position and a disengaged position). It should be appreciated that in alternate embodiments of the present invention, the clamp 22 may not be free to move to an entirely horizontal position. However, in these alternate embodiments, the clamp 22 will preferably still be able to move between an engaged position where it is in firm contact with an earlobe and a disengaged position where it is remote from an earlobe when the earring 10 is in assembled position on a person's ear.

The clamp 22 includes a bottom portion 26 arranged at the pivotal connection 24 between the clamp 22 and the extension member 20, and a top-most location 28. The clamp 22 shown in FIGS. 1–8 is similar to an omega backing member which is well known for use with clip-on earrings.

In a preferred embodiment of the present invention, the distance between the bottom-most portion of the spherical member 18 and the top-most portion 28 of the clamp 22 is less than about one half inch when the clamp 22 is in its upright position as shown in FIGS. 1–5. In alternate preferred embodiments, this distance may be less than about one quarter of an inch.

As shown in FIG. 1, the earring 10 is adapted to be mounted on a non-pierced ear 30. More particularly, the spherical member 18 at the second end of the elongated arcuate arm 16 is sized and shaped to comfortably fit within the exterior canal 36 at the front side 32 of an ear 30. Still, more particularly, the spherical member 18 may be placed substantially adjacent to the auricle 38 when mounted on the ear 30. At the same time, the clamp 22 is placed in an engaged position against the rear side 34 of the earlobe 40. The combination of the mounting member 14 and the clamp 22 is considered the backing of the earring 10, and facilitates the secure mounting of the earring 10 in assembled position on a person's ear 30.

It should be appreciated that the mounting member 14 and the pivotable clamp 22 can be arranged, or integrally formed, on substantially any type of earring to securely mount the ornamental component thereof on a non-pierced ear. In a preferred embodiment, the mounting member 14 is integral with the ornamental component 12. However, in alternate embodiments, the mounting member 14 may not be integral with ornamental component 12 and may be separately connected thereto.

As shown in the preferred embodiment of FIGS. 1–8, the clamp 22 is pivotally mounted to extension member 20 at connection 24. It should be appreciated that in alternate embodiments of the present invention, the clamp 22 may be directly mounted to the ornamental component. However, in either embodiment, the clamp 22 is considered to be connected, either directly or indirectly, to the associated ornamental component.

It is desirable for the clamp 22 to be retained in an engaged position adjacent to the rear side of the earlobe 40 to further support the earring 10 in assembled position. In order to accomplish this, retention means may be provided which retain the clamp 22 in an upright position. Various types of retention means may be used within the scope of the present invention. For example, a friction engagement mechanism may be used. Further, a separate latch or locking mechanism may be used to permit the clamp 22 to be moved from it disengaged position shown in FIG. 6 to its engaged position shown in FIGS. 1–5.

The backing system of the present invention is particularly advantageous in mounting relatively large, heavy earrings on a person's ear. The placement of the spherical member 18 in its mounted position within the exterior canal 36 of the ear 30, adjacent to the auricle 38 thereof, directs the vertical forces due to the mass of the earring and gravity to a much sturdier portion of the ear than the earlobe 40. Use of the present earring 10 will therefore greatly reduce the risk of injury or disfiguration to the earlobe 40.

As can be appreciated, the appearance of ornamental component 12 shown in FIGS. 1–8 has been selected by way of illustration only. To this end, infinite variations of the ornamental appearance of the ornamental component 12 of the earring 10 can be used in conjunction with the novel backing system of the present invention. Further, it should be appreciated that various modifications can be made to the structure of the backing components of the earring 10 while remaining within the scope of the present invention which is defined by the claims set forth below.

I claim:

1. An earring comprising: at least one ornamental component; a mounting member rigidly connected to said at least one ornamental component and being adapted to rest within an external cavity at the front side of an ear; and a clamp connected to said at least one ornamental component for pivotal movement between a disengaged position where it is remote from said ear and an engaged position where it is placed in contact with the rear side of an earlobe whereby secured assembly of said at least one ornamental component on the ear is obtained, said mounting member including an elongated arm having a first end and a second end, said first end being connected to said at least one ornamental component, and said second end including a spherical member, said spherical member being constructed and arranged to rest within the external cavity at the front side of the ear, said clamp including a top-most portion and said spherical member including a bottom-most portion, said bottom-most portion of said spherical member being spaced from said top-most portion of said clamp by between about 1.0 mm–10.0 mm when in assembled position mounted on an ear.

2. The earring of claim 1 wherein said bottom-most portion of said spherical member being spaced from said top-most portion of said clamp by about 4.0 mm when in assembled position mounted on an ear.

3. The earring of claim 2 wherein said elongated arm has an arcuate configuration between said first end and said second end thereof.

4. The earring of claim 1 further comprising an extension member connected to said at least one ornamental component, said clamp being pivotally connected to said extension member for selective movement toward or away from said at least one ornamental component and the earlobe.

5. The earring of claim 4 wherein a frictional relationship exists between said clamp and said extension member at said pivotal connection for retaining said clamp in said engaged position against the earlobe.

6. The earring of claim 1 wherein said clamp comprises an omega backing member.

7. The earring of claim 6 wherein said omega backing member has a total length of between about 1.5–2.5 cm.

8. The earring of claim 7 wherein said omega backing member has a total length of about 1.8 cm.

9. The earring of claim 1 wherein said mounting member is integral with said at least one ornamental component.

10. The earring of claim 9 wherein said elongated arm has an arcuate configuration between said first end and said second end thereof.

11. The earring of claim 9 further comprising an extension member connected to said at least one ornamental component, said clamp being pivotally connected to said extension member for selective movement toward or away from said at least one ornamental component and the earlobe.

12. The earring of claim 4 wherein the distance between said bottom-most portion of said spherical member and said pivotal connection at said clamp and said extension member is between about 2.0 mm–3.0 mm.

13. The earring of claim 12 wherein the distance between said bottom-most portion of said spherical member and said pivotal connection at said clamp and said extension member is about 2.2 mm.

14. An earring comprising: an ornamental component; a mounting member integrally connected to said ornamental component, said mounting member being adapted to rest within an external cavity at the front side of an ear; and a clamp connected to said ornamental component for pivotal movement between a disengaged position where it is remote from said ear and an engaged position where it is placed in contact with the rear side of an earlobe whereby secured assembly of the ornamental component on the ear is obtained, said mounting member including an elongated arm having a first end and a second end, said first end being connected to said ornamental component, and said second end including a spherical member, said spherical member being constructed and arranged to rest within the external cavity at the front side of the ear, said clamp including a top-most portion and said spherical member including a bottom-most portion, said bottom-most portion of said spherical member being spaced from said top-most portion of said clamp by between about 1.0 mm–10.0 mm when in assembled position mounted on an ear.

15. The earring of claim 14 wherein the distance between said mounting member and said clamp is about 4.0 mm.

16. The earring of claim 14 further comprising an extension member connected to said ornamental component, said clamp being pivotally connected to said extension member for selective movement toward or away from said ornamental component and the earlobe.

17. The earring of claim 16 wherein the distance between said bottom-most portion of said spherical member and said pivotal connection at said clamp and said extension member is between about 2.0 mm–3.0 mm.

18. The earring of claim 17 wherein the distance between said bottom-most portion of said spherical member and said pivotal connection at said clamp and said extension member is between about 2.2 mm.

19. The earring of claim 14 wherein said clamp has a total length of between about 1.5–2.5 cm.

20. The earring of claim 17 wherein said clamp has a total length of about 1.8 cm.

21. The earring of claim 18 wherein said mounting member is integral with said at least one ornamental component.

* * * * *